US005823753A

United States Patent [19]

Kemmerling

[11] Patent Number: 5,823,753

[45] Date of Patent: Oct. 20, 1998

[54] METAL REINFORCED PUMP COVER OF AN ELECTRICALLY DRIVEN AIR PUMP

[75] Inventor: Frank Kemmerling, Grevenbroich, Germany

[73] Assignee: Pierburg GmbH, Neuss, Germany

[21] Appl. No.: 535,660

[22] Filed: Sep. 28, 1995

[30] Foreign Application Priority Data

Oct. 29, 1994 [DE] Germany ..... 44 38 751.2

[51] Int. Cl.[6] ..... F04B 39/12; F04D 29/02

[52] U.S. Cl. ..... 417/423.14; 415/200; 415/915

[58] Field of Search ..... 417/423.14, DIG. 1; 415/200, 915

[56] References Cited

U.S. PATENT DOCUMENTS

| | | | |
|---|---|---|---|
| 4,234,291 | 11/1980 | Hurst et al. | 417/200 |
| 4,639,191 | 1/1987 | Hart . | |
| 5,055,006 | 10/1991 | Kobayashi et al. | 417/423.14 |

FOREIGN PATENT DOCUMENTS

| | | | |
|---|---|---|---|
| 0385298 | 9/1990 | European Pat. Off. . | |
| 2307688 | 8/1974 | Germany | 415/200 |
| 2706110 | 8/1978 | Germany | 415/200 |
| 4107049 | 9/1992 | Germany . | |
| 60-22500 | 10/1985 | Japan . | |

*Primary Examiner*—Charles Freay
*Assistant Examiner*—Roland G. McAndrews, Jr.
*Attorney, Agent, or Firm*—Ladas & Parry

[57] ABSTRACT

An electrically driven air pump has a housing incorporating an electric motor in one section of the housing and a pump mechanism coupled to the motor in another section of the housing. The housing has a pump cover enclosing the pump mechanism, made of plastic and having an end wall to which a metal reinforcement member is joined by injection molding. The metal reinforcement member is formed as a ring having inner and outer perimetral surfaces and a plurality of radial slots are formed in the ring for passage of the plastic material therethrough to anchor the reinforcement member to the end wall. The slots extend from the inner perimetral surface of the ring towards the outer perimetral surface but terminate before reaching the outer perimetral surface. The outer perimetral surface of the metal reinforcement member is free and unobstructed for undergoing dimensional change due to temperature variation.

15 Claims, 1 Drawing Sheet

METAL REINFORCED PUMP COVER OF AN ELECTRICALLY DRIVEN AIR PUMP

FIELD OF THE INVENTION

The invention relates to electrically driven air pumps, for example, for motor vehicles for supplying secondary air to the exhaust system to reduce pollutants in the exhaust gases.

The invention relates in particular to the construction of such pumps to reduce vibration thereof.

BACKGROUND AND PRIOR ART

In a pump of this type (EPA 0 385,298 A2), there is the problem that its operation is unavoidably associated with vibrations of variable magnitude due to imbalance of the rotor and the electric motor, as well as the developed magnetic rotating field. These vibrations are transmitted to the apparatus connected to the pump and to the pump support causing operating noise.

An air pump of this type is disclosed in DE-A1 41 07 049 which includes means for reducing vibration and operating noise. However, low frequency operating noise still remains due to a membrane effect of the pump cover, made of plastic and having an air inlet connection, in cooperation with other structural parts of the pump.

This low-frequency operating noise has been eliminated by making the axial end wall of the pump cover more rigid by riveting a metal reinforcement member to the pump cover. This has remained as the only currently available mode of reinforcement. Injection molding of the metal reinforcement member with the pump cover has not been considered as being operable due to the different coefficients of thermal expansion of the metal and plastic materials. Joinder by riveting the metal reinforcement member to the plastic cover, however, is expensive and does not completely eliminate the development of temperature stresses caused by the differences in the thermal coefficients between the pump cover and the metal reinforcement member, which can lead to a failure of the pump.

SUMMARY OF THE INVENTION

An object of the invention, is to provide an air pump having reduced operating noise and wherein the axial end wall of the plastic pump cover is reinforced by a metal reinforcement member joined thereto by injection molding.

A further object of the invention is to provide a joinder of the metal reinforcement member and the plastic cover by injection molding in which expansion of the metal reinforcement member is permitted relative to the plastic cover.

In order to satisfy the above and further objects of the invention, the metal reinforcement member is provided with apertures means between inner and outer perimetral surfaces thereof through which the plastic of the end wall extends by the injection molding operation to anchor the reinforcement member to the end wall such that said outer perimetral surface of the metal reinforcement member is free and unobstructed for undergoing dimensional change due to temperature variation.

In accordance with a particular embodiment of the invention, the end wall includes axially spaced wall portions between which the metal reinforcement member is secured.

Advantageously, the metal reinforcement member is in the form of a thin ring-shaped element having inner and outer perimetral surfaces which are annular in shape. The aperture means is in the form of a plurality of slots in the ring-shaped element which extend radially from the inner perimetral surface towards the outer perimetral surface and terminate at a distance from said outer perimetral surface.

DETAILED DESCRIPTION OF PREFERRED EMBODIMENTS

Figure 2:
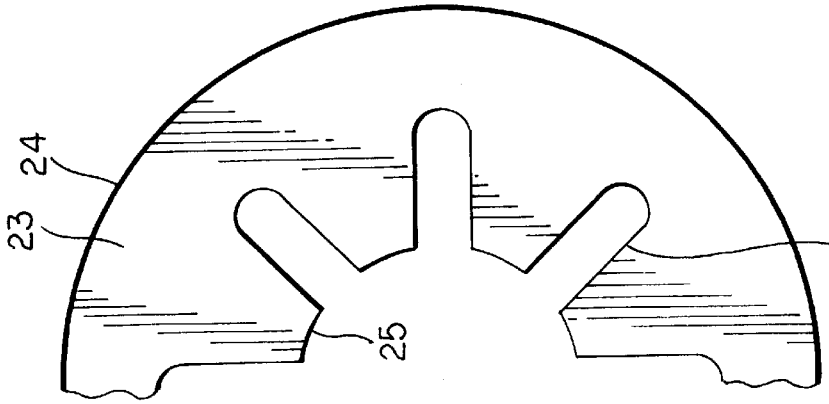
FIG. 2 is an end view of one half of a metal reinforcement member of the air pump of FIG. 1.
Figure 1:
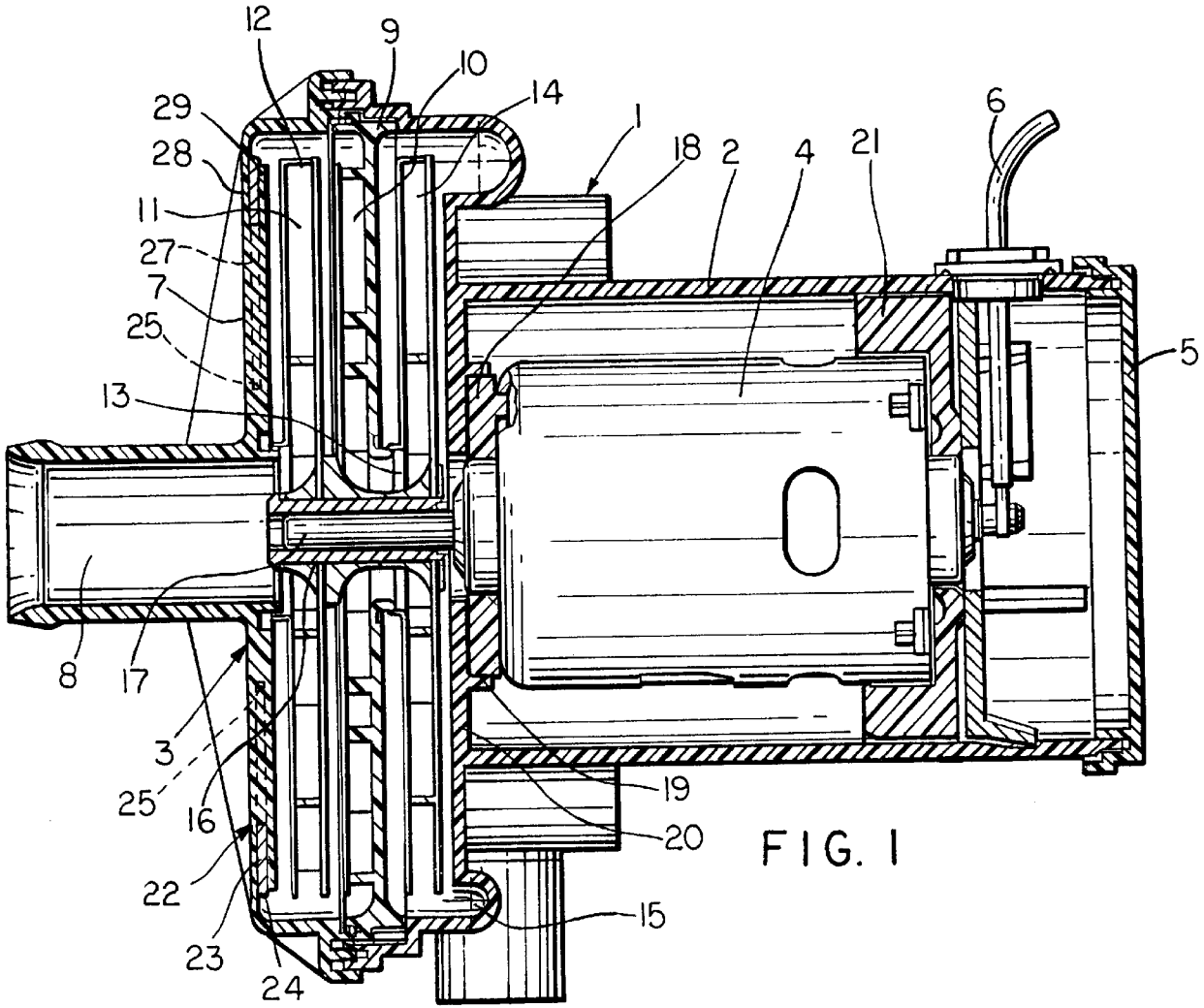
FIG. 1 is a longitudinal sectional view through one embodiment of an electrically driven air pump according to the invention.

FIG. 1 shows an air pump 1 of the invention, comprising a housing 2 made of plastic, which forms one portion containing a pump mechanism 3 and a second portion containing an electric motor 4. Housing 2 is sealed at the axial end of the portion containing the electric motor by a cover 5 and the housing 2 has an opening for passage of an electrical connection cable 6 of electric motor 4. The pump mechanism 3 is sealed by a pump cover 7 of housing 2, the pump cover 7 being of cup-shape and having an air inlet connection 8. A rotor 9 of the pump mechanism is supported within housing 2, and rotor 9 is provided with channels 10, through which air supplied by a first rotor 11 from its outer outlet 12 is again introduced into the inner air inlet 13 of another rotor 14. Housing 2 has an annular channel 15 in the region of the last rotor 14, for delivery of air under pressure to a pressure outlet connection (not shown).

The two rotors 11, 14 have hubs 16 fixed to a shaft 17 of electric motor 4, which projects into the portion of the housing containing the pump mechanism.

Electric motor 4 is supported by a first elastomer ring 18 in a recess 19 of a housing wall 20 separating the pump mechanism from the electric motor, and by a second elastomer ring 21.

Up to this point the described construction is conventional.

According to the invention an axial end wall 22 of the pump cover 7, made of plastic material, is joined to a metal reinforcement member 23 by injection molding. Thereby, vibratory movement of the relatively flexible end wall by the pumping action of the pump is suppressed. The metal reinforcement member 23 has an outer perimetral surface 24 and an inner perimetral surface 25. The reinforcement member is in the form of a ring with a central circular hole so that the perimetral surfaces are circular, peripheral surfaces. Aperture means in the form of slots 26 extend radially from the inner perimetral surface 25 towards the outer perimetral surface 24 and terminate at a distance from outer perimetral surface 25. The perimetral outer end of the metal reinforcement ring projects from the plastic of the pump cover wall so that the outer perimetral surface 24 is free and unobstructed for undergoing dimensional change due to temperature variation.

The slots 26 are filled with plastic in the injection molding process and form anchors 27, which are integrated with the axially spaced wall portions 28, 29 of wall 22 on both sides of the metal reinforcement member 23. After the injection molding process, the plastic material adjoining the metal reinforcement ring is now free to shrink during cooling without buildup of stresses, since the outer perimetral edge 24 of the metal reinforcement member 22 is free to slide relative to the plastic pump cover wall and similarly the plastic anchors 27 in slots 26 can slide relative to the slots 26.

In the case of heating of the pump cover 7, which occurs after initial cooling following the injection molding, a free expansion of the metal reinforcement ring can take place due to the formation of the clear free spaces due to shrinkage after the injection molding process.

A cost-saving anchoring of the metal reinforcement member has been obtained by the invention compared to riveting, and in addition, the metal reinforcement member has greater capability of free expansion. Additionally, the metal reinforcement member does not have to be manufactured with close tolerances as required when it is attached to the cover by riveting since these tolerances are compensated by axial wall portions 28, 29 of pump cover 7.

Although the invention has been described in relation to specific embodiments thereof, it will become apparent to those skilled in the art that numerous modifications and variations can be made within the scope and spirit of the invention as defined in the attached claims.

What is claimed is:

1. An electrically driven air pump comprising a housing including an electric motor in one section of the housing and a pump mechanism coupled to the motor in another section of the housing, said housing including a pump cover on said one section enclosing said pump mechanism, said pump cover being made of plastic and having an end wall including a metal reinforcement member joined by injection molding to said end wall, said metal reinforcement member having inner and outer perimetral surfaces and aperture means between said surfaces through which the plastic of said end wall extends by said injection molding to anchor the reinforcement member to said end wall, said outer perimetral surface of the metal reinforcement member being free and unobstructed for undergoing dimensional change due to temperature variation.

2. A pump as claimed in claim 1, wherein said end wall includes spaced wall portions between which said metal reinforcement member is secured.

3. A pump as claimed in claim 2, wherein said pump cover is cup shaped, said metal reinforcement member being joined to said pump cover at an inner surface thereof.

4. A pump as claimed in claim 3, wherein said metal reinforcement member comprises a thin ring-shaped element whose inner and outer perimetral surfaces are annular in shape.

5. A pump as claimed in claim 4, wherein said aperture means comprises a plurality of radial slots in said ring-shaped element.

6. A pump as claimed in claim 5, wherein said slots extend radially from said inner perimetral surface towards said outer perimetral surface and terminate at a distance from said outer perimetral surface.

7. A pump as claimed in claim 6, comprising an air inlet connection extending from said pump cover.

8. A pump as claimed in claim 6, wherein said inner perimetral surface of the metal reinforcement ring is formed by a central circular hole in said ring.

9. A pump cover for an electrically driven air pump to enclose a pumping mechanism of the pump, said pump cover comprising a plastic housing having an axial end wall with a metal reinforcement member joined to said end wall by injection molding, said metal reinforcement member having inner and outer perimetral surfaces and aperture means between said surfaces through which the plastic of said end wall extends by said injection molding to anchor the reinforcement member to said end wall, said outer perimetral surface of the metal reinforcement member being free and unobstructed for undergoing dimensional change due to temperature variation.

10. A pump cover as claimed in claim 9, wherein said end wall includes axially spaced wall portions between which said metal reinforcement member is joined with said outer perimetral surface thereof extending freely.

11. A pump cover as claimed in claim 10, wherein said metal reinforcement member comprises a thin ring-shaped element whose inner and outer perimetral surfaces are annular in shape.

12. A pump cover as claimed in claim 11, wherein said aperture means comprises a plurality of radial slots in said ring-shaped element.

13. A pump cover as claimed in claim 12, wherein said slots extend radially from said inner perimetral surface towards said outer perimetral surface and terminate at a distance from said outer perimetral surface.

14. A pump cover as claimed in claim 13, comprising an air inlet connection extending from said pump cover.

15. A pump cover as claimed in claim 13, wherein said inner perimetral surface of the metal reinforcement ring is formed by a central circular hole in said ring.

* * * * *